US008534511B2

(12) United States Patent
Carvalho

(10) Patent No.: US 8,534,511 B2
(45) Date of Patent: Sep. 17, 2013

(54) CURVED TUBULAR SPOUT WITH DISTAL CHAMFER

(76) Inventor: David de Carvalho, São Paulo (BR)

( * ) Notice: Subject to any disclaimer, the term of this patent is extended or adjusted under 35 U.S.C. 154(b) by 319 days.

(21) Appl. No.: 12/676,508

(22) PCT Filed: Sep. 2, 2008

(86) PCT No.: PCT/BR2008/000273

§ 371 (c)(1),
(2), (4) Date: Mar. 4, 2010

(87) PCT Pub. No.: WO2009/030010

PCT Pub. Date: Mar. 12, 2009

(65) Prior Publication Data

US 2010/0181349 A1 Jul. 22, 2010

(30) Foreign Application Priority Data

Sep. 4, 2007 (BR) ..... PI0703809-7

(51) Int. Cl.

| | |
|---|---|
| ***B65D 5/72*** | (2006.01) |
| ***B65D 25/40*** | (2006.01) |
| ***B65D 35/38*** | (2006.01) |
| ***B05B 1/00*** | (2006.01) |

(52) U.S. Cl.
USPC ..... 222/571; 222/566; 239/598; 239/599

(58) Field of Classification Search
USPC ..... 222/566–573, 575; 239/601, 597–599; 138/92, 109, DIG. 11; 604/272
See application file for complete search history.

(56) References Cited

U.S. PATENT DOCUMENTS

| | | | | | |
|---|---|---|---|---|---|
| 1,986,250 | A | * | 1/1935 | Cole | 222/321.5 |
| 2,293,610 | A | * | 8/1942 | McQuinn | 29/6.1 |
| 2,781,956 | A | * | 2/1957 | Sherbondy | 222/491 |
| 2,822,965 | A | * | 2/1958 | Smith | 222/571 |
| 3,190,511 | A | * | 6/1965 | Daly | 222/478 |
| 3,501,064 | A | * | 3/1970 | Gaumer | 222/358 |
| 4,061,255 | A | * | 12/1977 | Davies | 222/566 |
| 4,105,148 | A | | 8/1978 | Williams | |
| 4,382,530 | A | * | 5/1983 | Calisto | 222/567 |
| 4,887,744 | A | * | 12/1989 | Williams | 222/402.1 |

(Continued)

FOREIGN PATENT DOCUMENTS

| | | | |
|---|---|---|---|
| DE | 4037673 | A1 * | 6/1992 |
| GB | 2 399 073 | | 9/2004 |

OTHER PUBLICATIONS

Cynthia (Cooper) David, Sizzling Suggestions for Your Favourite Chef, Toronto Star, Nov. 28, 2002, p. K.15 Rosendahl GC Drip Free Oil Spout); Product site: (http://www.rosendahl.com/Products_from_Rosendahl.aspx?ProductID=25442&VariantID=&GroupID=KK_GC).*

(Continued)

*Primary Examiner* — Paul R Durand
*Assistant Examiner* — Matthew Lembo
(74) *Attorney, Agent, or Firm* — Alston & Bird LLP

(57) ABSTRACT

Improvement in a pouring spout for liquids of various viscosities comprising a small tube with adequate diameter and length (1) presenting its distal extremity curved in a cuneiform angle (2) forming a pouring mouth (3), oval or elliptical, angularly oriented downwards, which larger axis (4) extends longitudinally along with such small tube (1) so that its superior extremity or superior distal edge (5) is extended outwards and its inferior opposite edge (6) is retreated backwards.

3 Claims, 12 Drawing Sheets

(56) References Cited

U.S. PATENT DOCUMENTS

| | | | | |
|---|---|---|---|---|
| 5,277,343 | A | 1/1994 | Parsonage | |
| 5,290,267 | A * | 3/1994 | Zimmermann | 604/272 |
| 5,588,560 | A * | 12/1996 | Benedict et al. | 222/106 |
| 5,843,048 | A * | 12/1998 | Gross | 604/264 |
| 5,893,839 | A * | 4/1999 | Johnson | 604/506 |
| 6,524,103 | B1 * | 2/2003 | Winkler et al. | 433/90 |
| 6,730,061 | B1 * | 5/2004 | Cuschieri et al. | 604/158 |
| 7,198,175 | B2 * | 4/2007 | Ophardt | 222/188 |
| 7,387,222 | B2 * | 6/2008 | Thompson et al. | 222/527 |
| 2001/0014788 | A1 * | 8/2001 | Morris | 604/170.03 |
| 2007/0017938 | A1 | 1/2007 | Thompson et al. | |
| 2007/0194061 | A1 * | 8/2007 | Rosegrant et al. | 222/571 |

OTHER PUBLICATIONS

John Hesselberth, How to Make Drip Free Spouts, Jan./Feb. 1997, Clay Times, <http://www.frogpondpottery.com/articles/dripfree.html>.*

Search Report and Written Opinion for PCT/BR2008/000273 dated Nov. 28, 2008.

International Preliminary Report on Patentability for PCT/BR2008/000273 dared Nov. 11, 2009.

* cited by examiner

- PRIOR ART -

CURVED TUBULAR SPOUT WITH DISTAL CHAMFER

FIELD OF INVENTION

More particularly this present Invention refers to a pouring spout subject to be used in different containers or flasks, whether domestic or industrial, rigid, semi-rigid and flexible, disposable or not, where such spout has, as its main objective, perform the pouring of liquids of different viscosities (water, vinegar, wine and other beverages, olive oil, vegetal and mineral oils, honey and other viscous liquids), and the main novelty of this current spout is providing cooperative constructive means to avoid that part of the dispensed liquid drips on the external side (inferior edge) of the spout itself (non dripping spout) and on the container or flask and does not wet the face of the liquid pouring mouthpiece.

STATE OF THE ART

There is currently a great variety of spouts for this end, such as those described in documents: U.S. Pat. No. 6,431,417B1, U.S. Pat. No. 6,968,980; U.S. Pat. No. 6,895,672, U.S. Pat. No. 7,185,790, U.S. Pat. No. 6,609,639, U.S. Pat. No. 6,474,514, US D538,891, US D538,892S and U.S. Pat. No. 5,398,829, as well as those indicated by FIG. 1. Among other characteristics of this type of spout, an important one is a cooperative configuration for the product not to drip through the external side of the spout and the recipient, regardless of the product's viscosity.

As usually known, it can be observed in restaurants, residences and other food serving places, that the olive oil recipients are wrapped by an absorbent element, mainly cloth or paper napkins, or they are even inside a decoration cover. These resources are used to avoid that the olive oil pours out through the hole made directly in the recipient or through a spout, to spread onto non desired places and to avoid dirtying the place or the tablecloth. Even in most part of glass recipients equipped with pouring spouts, whether metallic or plastic, the oil product drips very easily through the inferior edge of the spout. Almost the totality of the existing spouts, when used to pour viscous liquids, olive oils, oils in general etc., when placing the recipient to its normal position (vertical), a small part of these liquids drips through the inferior edge of the spouts or they wet it when used. There are some recipients which are constructed in such a way that the liquid pouring from the inferior edge is collected and directed back inside it. There are other spouts that, when used, do not let the liquid drip through the inferior edge of the spout, but due to its use, the face of the pouring mouthpiece gets wet because of the liquid and, in time, so is the inferior edge of the spout.

Therefore, the current existing spouts do not have efficient means to avoid the product from dripping. This deficiency can be seen due to the construction that, although variable, does not avoid the aforesaid problem.

As exemplified by FIGS. 1A and 1B most part of the existing spouts in the market present cylindrical, straight or slightly curved shape, and the section of the pouring mouthpiece with a circular geometry and perpendicular to the longitudinal axis.

In some cases, as exemplified by FIG. 1C, the tip of the spout is cut in the form of a bevel (chamfered or cuneate), where the inclination or incline starts in the superior edge and finishes in the inferior distal edge, towards the outlet of the liquid.

There is another type that also stands out, illustrated by FIG. 1D, which has a lip at the inferior distal extremity of the outlet mouth.

There are other spouts (FIG. 1E) with more or less conspicuous curvatures, and can also present a curvature equal or next to 90°, so that the dispensing mouthpiece is perpendicular to the axis of the cylinder.

Finally FIG. 1F, where an additional lip in the inferior edge allows the liquid that pours through the inferior edge to drip where the liquid is being dispensed.

Obviously all the above mentioned spouts also allow viscous liquids to be easily poured; however, none of them avoids their dripping from the spout and, consequently, the recipient itself.

OBJECTIVES OF THE INVENTION

Considering all the above, this present improvement was developed, which main characteristic is the fact that a small tube with a determined length is curved or bended at any angle in between 0 and 90 degrees in relation to the axis of the spout inlet mouthpiece, through where the liquid enters, and this improvement presents its distal extremity chamfered in the form of a bevel, so that the chamfer starts in the inferior edge and finishes in the superior edge in the direction of the liquid outlet. When spilling the spout (recipient) the liquid flows guided by the superior inner part of the spout until its extremity (5). When returning the spout to its initial position (recipient in vertical position), the liquid, as a whole, returns through the superior inner edge to the recipient and, due to its mouthpiece construction, the liquid does not find any surface whereon it can drip.

With the above improvement, the configuring of several pouring spouts, with the outlet mouthpiece as described above, is possible. It may be chamfered in several angles, there is also the possibility to radically vary the angle of curvature or bend of the tube, as well as its diameter, thickness of its wall and the material of what it is made, which can be metallic or plastic, including glass. Our tests were carried out with spout prototypes in several shapes and diameters: ¼" (6.35 mm), 5⁄16" (7.938 mm), ⅜" (9.525 mm), ½" (12.7 mm), built in plastic, copper and stainless steel, using liquids of various viscosities and types of recipients with several types of air vents.

In any adopted configuration, the outlet mouthpiece offers means for the liquids, with low viscosity (water, vinegar, wine etc.) and those more viscous (olive oil, vegetal and mineral oils, honey and other viscous liquids etc.), not to drip through the inferior edge of the spout after use, and not to wet the face of the mouthpiece and the inferior edge due to frequent use.

Therefore, the basic concept of this improvement is to offer efficient means for different spouts where the pouring occurs avoiding that the liquid, when returning to the interior of the recipient, be in contact with the inferior part of the mouthpiece and consequently drips through its external inferior edge.

With this present improvement it is possible to keep the same inventive concept for different shapes of spouts, among which:

a) those usually obtained from tubular parts with or without straight parts and preceding a curve or a bend with angles that vary from in between 0 to 90° in relation to the axis of the spout inlet mouthpiece wherein the liquid enters.

b) The cuneiform inclination adopted for the spout pouring mouthpiece to have variable angles, regardless of the shape adopted by the tube, respecting the concept that the edge or the superior extremity will always be distal in relation to the inferior edge or extremity, so that both can be combined to force the residual product inside the spout when the recipient is placed in vertical;

c) The pouring mouthpiece, besides its oval or elliptical shape, has almost no thickness, because the finishing in its entire perimeter is sharp-edged (blade) and due to this fact it has almost no surface (thickness);

d) As already mentioned, the tubular part of the spout and, consequently, its base may include resources to be fixed permanently or not, as well as it may be integrated with a lid, stopper or something similar, in a way that it may, or may not, be an integrating part of a container or flask, whether for domestic, commercial or industrial use, as well as the recipient or packaging may contain countless products, including those viscous, mainly oily in general, including the edible ones, mainly olive oil, but in any of its applications, many advantages are provided in relation to the conventional spouts, among which:

a) It provides more hygiene, obviously due to the fact that it avoids the product to drip along the outside of the spout and of the recipient;

b) It prevents wastes due to the fact that the liquid does not drip from the spout;

DESCRIPTION OF THE DRAWINGS

For a better comprehension of this present invention, the following detailed descriptions refer to the enclosed drawings, wherein.

DETAILED DESCRIPTION OF THE INVENTION

Figure 1A:
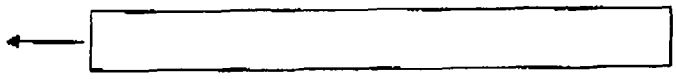
FIGS. 1A through 1F show schematic views of spouts already known by the state of the art.
Figure 1B:
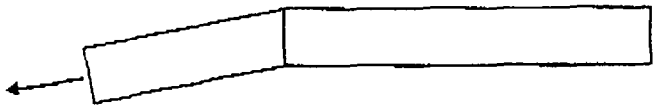
Figure 1C:
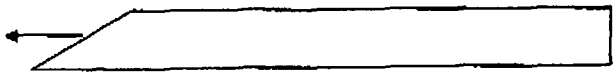
Figure 1D:
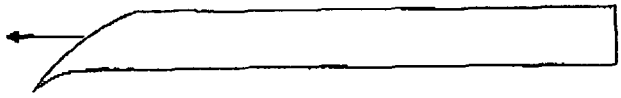
Figure 1E:
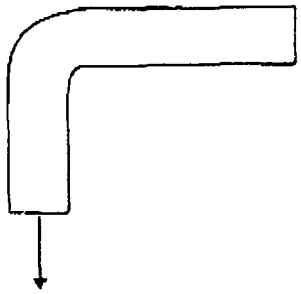
Figure 1F:
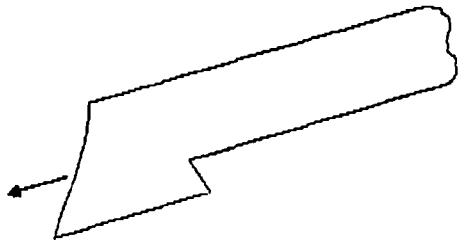
Figure 2A:
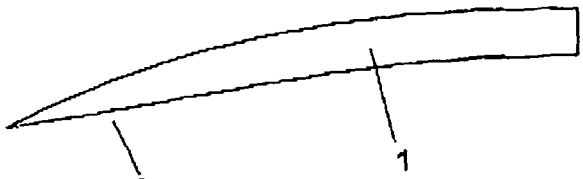
FIGS. 2A through 2E show a set of views of several different pouring spout configurations in accordance with the present invention.
Figure 2B:
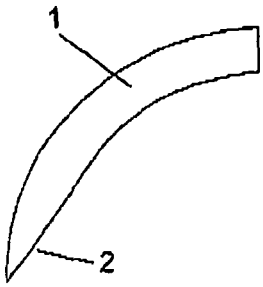
Figure 2D:
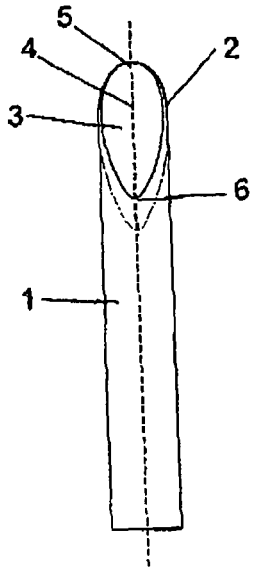
Figure 2C:
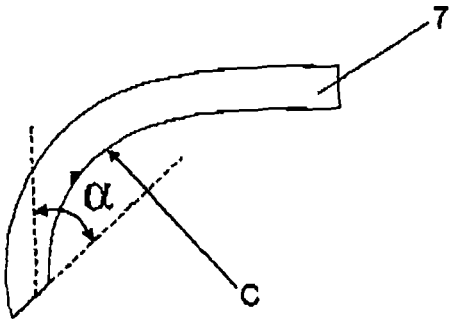
Figure 2E:
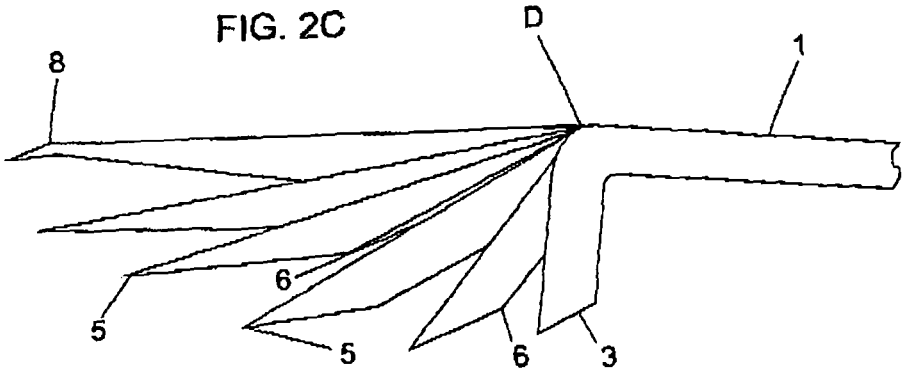
Figure 3A:
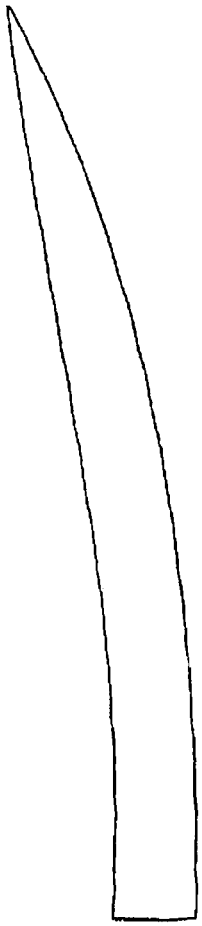
FIGS. 3A and 3B respectively illustrate profile and perspective views of a spout in accordance with one embodiment of the invention.
Figure 3B:
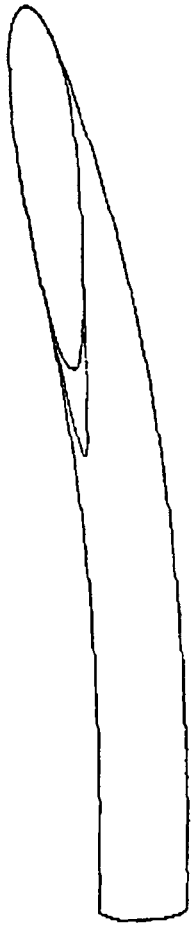
Figure 4A:
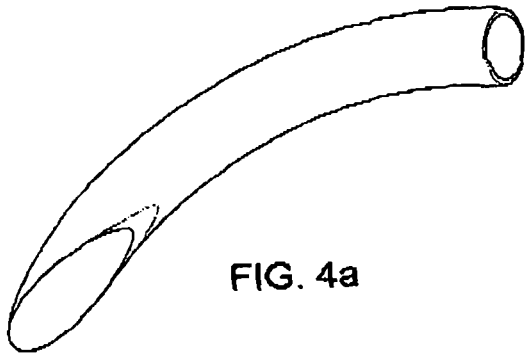
FIGS. 4*a* and 4*b* show perspective and profile views of a spout in accordance with another embodiment.
Figure 4B:
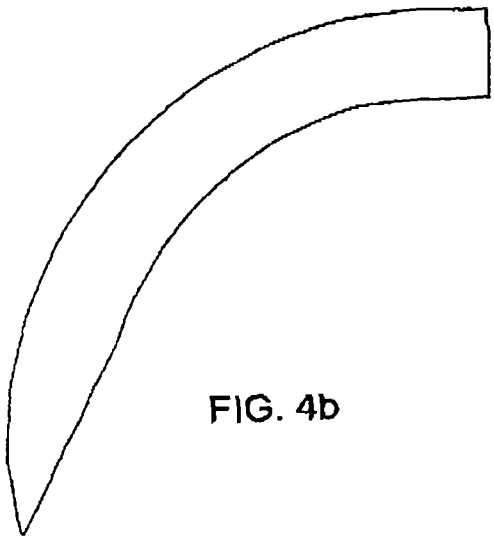
Figure 5A:
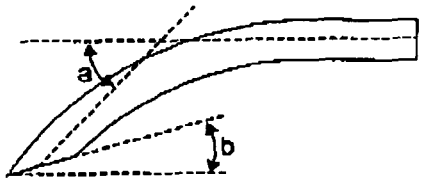
FIGS. 5A and 5B show profile and perspective views of a spout in accordance with yet another embodiment.
Figure 5B:
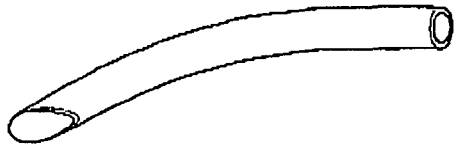
Figure 5C:
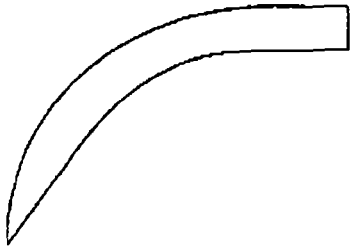
FIGS. 5C and 5D show profile and perspective views of a spout in accordance with a further embodiment.
Figure 5D:
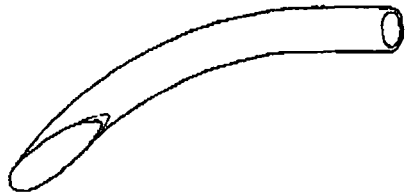
Figure 6A:
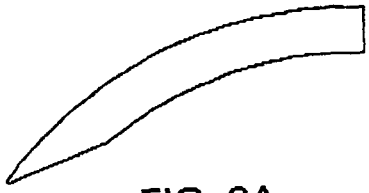
FIGS. 6A and 6B show profile and perspective views of a spout in accordance with another embodiment.
Figure 6B:
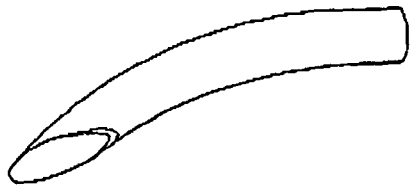
Figure 6C:
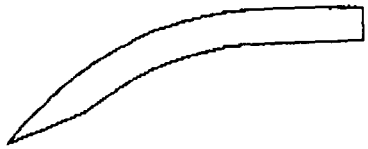
FIGS. 6C and 6D show profile and perspective views of a spout in accordance with another embodiment.
Figure 6D:
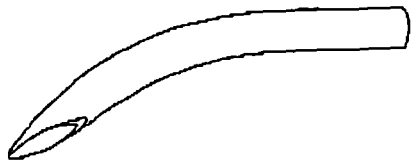
Figure 6E:
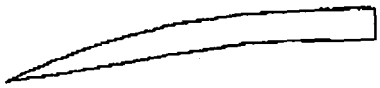
FIGS. 6E and 6F show profile and perspective views of a snout in accordance with another embodiment.
Figure 6F:
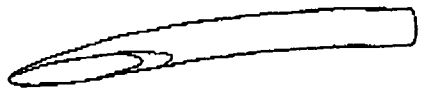
Figure 7A:
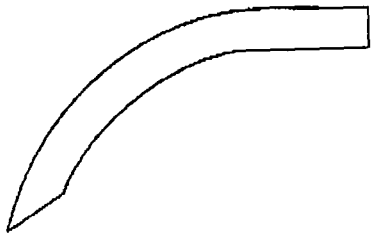
FIGS. 7A and 7B show profile and perspective views of a spout in accordance with still another embodiment.
Figure 7B:
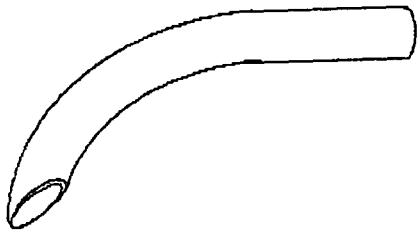
Figure 7C:
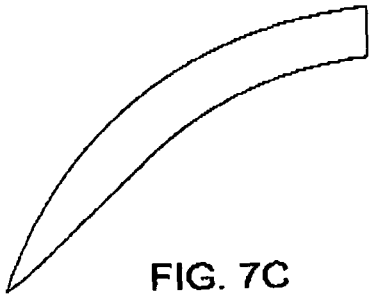
FIGS. 7C and 7D show profile and perspective views of a spout in accordance with another embodiment.
Figure 7D:
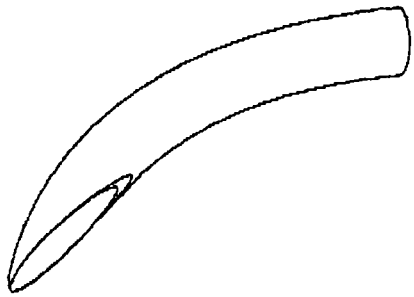
Figure 7E:
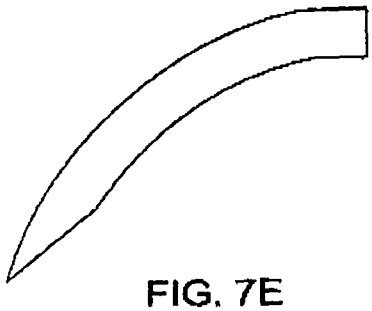
FIGS. 7E and 7F show profile and perspective views of a spout in accordance with another embodiment.
Figure 7F:
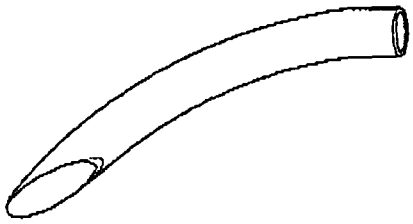
Figure 8A:
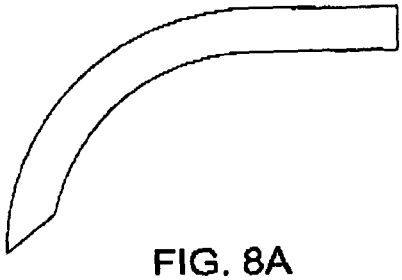
FIGS. 8A and 8B show profile and perspective views of a spout in accordance with still another embodiment.
Figure 8B:
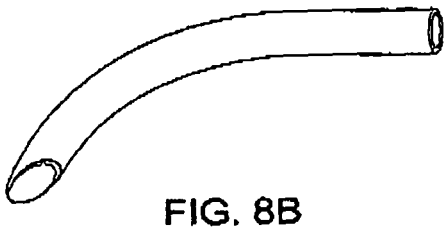
Figure 8C:
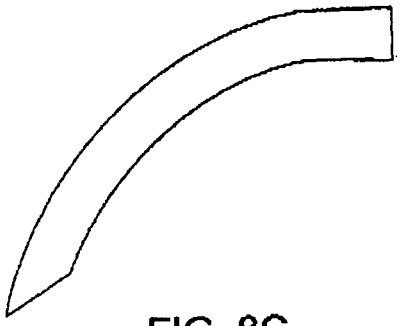
FIGS. 8C and 8D show profile and perspective views of a spout in accordance with another embodiment.
Figure 8D:
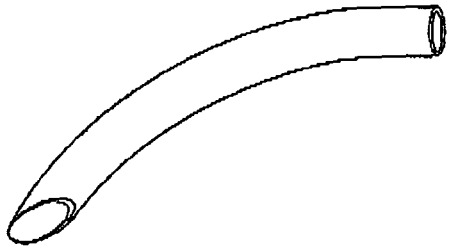
Figure 8E:
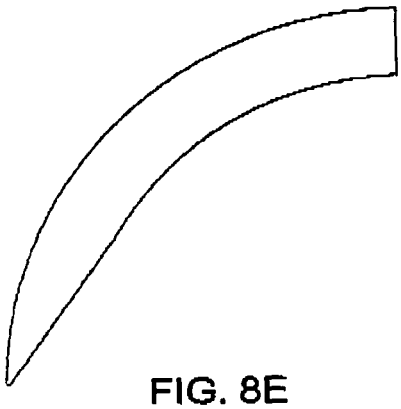
FIGS. 8E and 8F show profile and perspective views of a spout in accordance with another embodiment.
Figure 8F:
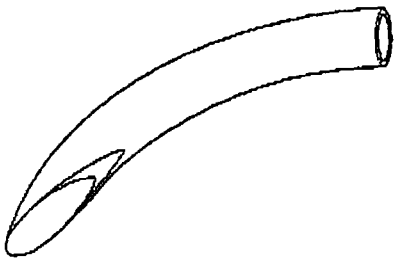
Figure 9A:
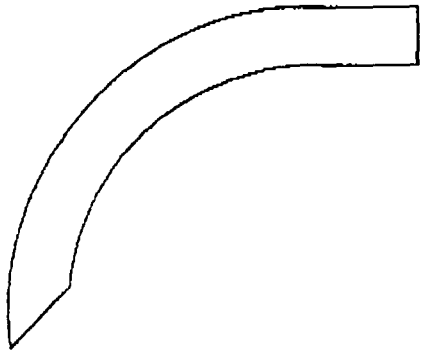
FIGS. 9A and 9B show profile and perspective views of a spout in accordance with still another embodiment.
Figure 9B:
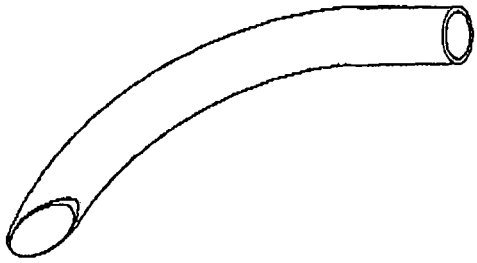
Figure 9C:
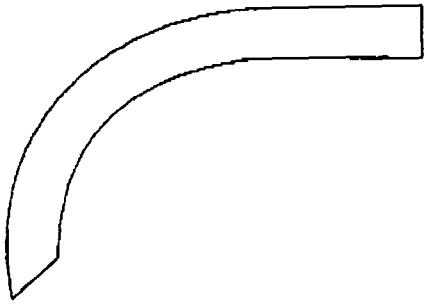
FIGS. 9C and 9D show profile and perspective views of a spout in accordance with another embodiment.
Figure 9D:
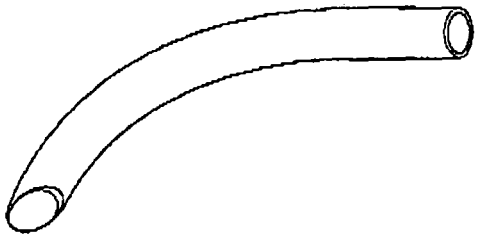

According to these illustrations and their details, more particularly FIG. 2, this current Invention, namely IMPROVEMENT IN POURING SPOUT FOR LIQUIDS OF VARIOUS VISCOSITIES, is characterized by the fact that a small tube with adequate diameter and length (1) presents its distal extremity bended in a cuneiform angle (2) forming a pouring mouth (3), oval or elliptical, angularly oriented downwards, which larger axis (4) extends longitudinally along with such small tube (1) in a way that its extremity or superior distal edge (5) is extended outwards and its opposite inferior edge (6) is retreated backwards.

The tube (1) is curved or bended in an angle that can vary from in between 0 to 90 degrees in relation to the spout inlet mouthpiece axis, wherein the liquid enters, i.e. the mouthpiece inside the container or flask. The angle ($\alpha$) between the mouthpiece plane (3) and the longitudinal center of the small tube (1) is always less than 90°.

The curvature (C) or bend (D) may or may not be preceded by a straight part with any length (7).

The distal extremity (5) may or may not be preceded by a rounding (8).

The pouring mouthpiece (3), besides its oval or elliptical shape, almost does not present thickness, because the finishing of its entire perimeter is sharp-edged (blade) and due to this fact it has almost no surface (thickness) even though the internal and external surrounding areas may or may not be alleviated by a rounding or a similar chiseling.

The perimeter of the mouthpiece may have several external finishing aiming a higher level of protection in case of inappropriate use, misuse or for decorative ends. However, the liquid in its path must be confined to the mouthpiece, which finishing is sharp-edged.

The spout herein has its liquid pouring mouthpiece chamfered in the form of a bevel, so that the chamfer starts in the inferior edge and finishes in the superior edge in the direction of the liquid outlet. When inclining the recipient, the liquid flows guided by the superior internal part of the spout until its extremity (5). When returning the recipient to its initial position (vertical), the liquid, as a whole, returns by the superior internal edge and, due to the construction of the inferior edge of the mouthpiece, it does not find any surface through which it may drip. FIGS. from 3 to 9 are enlarged views highlighting the lateral profile and a perspective of several spouts with varied curvatures and the pouring mouth in different angles, but keeping the same inventive concept described above. This spout, as well as its constructive variations, were successfully tested in prototypes where spouts of different diameters and shapes were used, whether made of plastic, copper and stainless steel in the following dimensions: ¼" (6.35 mm), 5/16" (7.938 mm), ⅜" (9.525 mm), ½" (12.7 mm), with several types of recipients and with several types of air vents and, in some cases, with no air vent.

In these tests the following items were detected:

a) There is a correspondence between the angle of the spout in relation to the axis of the straight part or the mouthpiece which is inside the recipient (a) and the angle of chamfer of the mouthpiece (b) (FIG. 5) and the viscosity of the liquid.

b) The velocity at which the liquid returns to the inside of the recipient depends on the type of air vent and the type of the recipient.

On the other hand, the spout has its base or extremity opposite to the pouring mouth (3) with any geometry, as well as it may include any complement of grooving and fixation to the place of use, and can even be an integrating part, or not, of a stopper, lid or something similar.

Therefore, the base of this present spout may include resources to be fixed permanently or not, as well as it may be integrated with a lid, a stopper or something similar, so that it may or may not be an integrating part of a recipient or packaging, whether for domestic, commercial or industrial use. The recipient or packaging may contain countless products, including those viscous, mainly oily, in a general way, including the edible ones, mainly olive oil, however, in any of its applications, many advantages are provided in relation to the conventional spouts, such as previously described.

Figure 10:
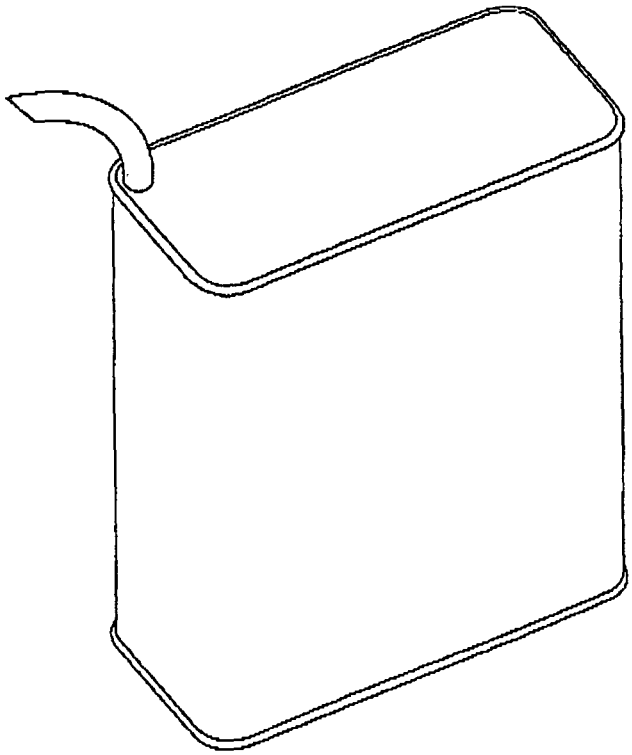
FIGS. 10 to 12 respectively illustrate three different types of containers, disposable or not, subject to use this current improved spout.

FIG. 10 exemplifies the use of this present spout in a can recipient, such as those for olive oils.

Figure 11:
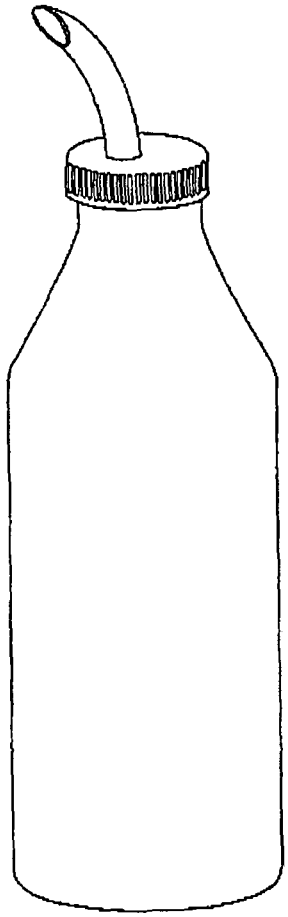
Figure 12:
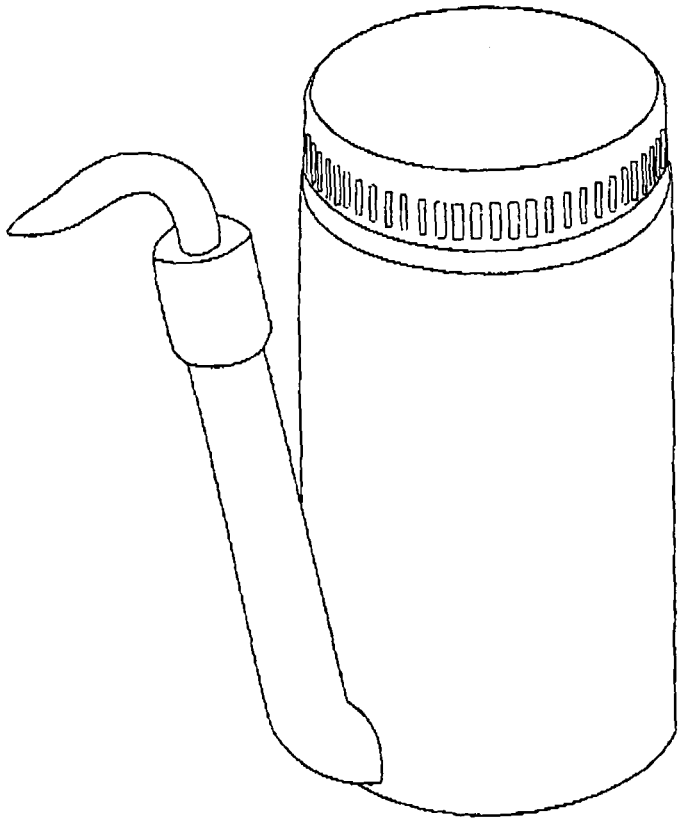

FIGS. 11 and 12 are other examples of use of this present spout.

Thus, one can realize that this present spout applies to different recipients and packaging, whether rigid, semi-rigid or flexible, disposable or not, including those metallic, plastic or glass made, among others.

The invention claimed is:

1. A non-drip spout for liquids of various viscosities, for use with rigid, semi-rigid or flexible containers, comprising:

a small tube having a substantially constant diameter along its entire length, through which liquid in the container is poured for dispensing the liquid, the tube extending from a proximal end configured for attachment to the container, to a distal extremity comprising a pouring mouth, the tube comprising a straight portion and a curved portion, wherein the curved portion extends from the pouring mouth back at least part of the way towards the proximal end;

wherein the pouring mouth is created by a chamfered cut in a plane that passes only through the curved portion, the pouring mouth comprising a superior edge and an inferior edge, the superior edge extending distally outwards and the inferior edge retreating proximally backward, the pouring mouth lies entirely in a plane that passes only through the curved portion of the tube at an acute angle with respect to a central axis of the tube at the pouring mouth tangent to the superior edge such that the pouring mouth is oval or elliptical with a major axis thereof extending generally longitudinally along the tube;

wherein a wall thickness of the tube measured in the plane of the pouring mouth varies about said perimeter thereof, from a minimum wall thickness at said superior edge to a maximum wall thickness at said inferior edge, wherein the superior edge of the perimeter of the pouring mouth is more-rounded than said inferior edge thereof;

wherein an angle between the central axis of the tube at the proximal end and the central axis of the tube at the pouring mouth tangent to the superior edge, which angle represents a net total amount of curving of the tube between the proximal end and the pouring mouth is greater than 0° and less than 90°; and wherein the curved portion is configured such that when the container with the spout is tipped from an initial vertical position to pour liquid out from the pouring mouth, the pouring mouth faces generally downwardly and liquid is guided through the superior edge, the superior edge being positioned lower than the inferior edge during pouring, and when the container is returned to the initial vertical position, the inferior edge is positioned lower than the superior edge and the liquid is guided through the superior edge back to the container.

2. The non-drip spout of claim 1, wherein a finishing of the entire perimeter of the pouring mouth is sharp-edged.

3. The non-drip spout of claim 1, wherein the tube includes a straight part located proximally with respect to the curved portion.

* * * * *